US007793393B2

(12) United States Patent
Roberts

(10) Patent No.: US 7,793,393 B2
(45) Date of Patent: Sep. 14, 2010

(54) URN WITH INTERCHANGEABLE DECORATIVE PANEL, MATTED GRAPHICS, AND METHOD FOR MAKING SAME

(76) Inventor: James H. Roberts, 1630 San Miguel Canyon Rd., Royal Oaks, CA (US) 95076-9132

( * ) Notice: Subject to any disclaimer, the term of this patent is extended or adjusted under 35 U.S.C. 154(b) by 238 days.

(21) Appl. No.: 11/977,163

(22) Filed: Oct. 23, 2007

(65) Prior Publication Data

US 2008/0251480 A1 Oct. 16, 2008

Related U.S. Application Data

(63) Continuation-in-part of application No. 11/053,264, filed on Feb. 7, 2005, now Pat. No. 7,308,740.

(51) Int. Cl.
*A61G 17/00* (2006.01)

(52) U.S. Cl. ..... 27/1

(58) Field of Classification Search ..... 27/1, 27/35; D99/5; 40/725, 722, 124.5
See application file for complete search history.

(56) References Cited

U.S. PATENT DOCUMENTS

| | | | | | |
|---|---|---|---|---|---|
| 3,167,844 | A * | 2/1965 | Bachofner | 27/1 |
| 4,199,848 | A * | 4/1980 | Kohnert | 27/1 |
| D268,374 | S * | 3/1983 | Dercks et al. | D99/5 |
| D268,623 | S * | 4/1983 | Dercks et al. | D99/5 |
| D272,577 | S * | 2/1984 | Dercks et al. | D99/5 |
| 4,648,162 | A * | 3/1987 | Daino | 27/1 |
| 5,230,127 | A * | 7/1993 | Zukowski et al. | 27/1 |
| 5,287,603 | A * | 2/1994 | Schorman | 27/1 |
| 5,740,637 | A * | 4/1998 | Snow | 52/136 |
| D440,735 | S * | 4/2001 | Robinson | D99/28 |
| 6,295,705 | B1 * | 10/2001 | Gersten | 27/1 |
| 6,735,831 | B1 * | 5/2004 | Greiwe et al. | 27/1 |
| D493,934 | S * | 8/2004 | Diviak, Sr. | D99/5 |
| 6,944,921 | B1 * | 9/2005 | Gersten | 27/1 |
| 7,043,803 | B2 * | 5/2006 | Chen | 27/1 |
| 7,191,499 | B2 * | 3/2007 | Davis et al. | 27/1 |
| 7,562,423 | B2 * | 7/2009 | Pryd-Kakuk | 27/1 |
| 2006/0207075 | A1 * | 9/2006 | Davis | 27/1 |
| 2007/0084743 | A1 * | 4/2007 | Chu | 206/455 |
| 2009/0030804 | A1 * | 1/2009 | Sell | 705/26 |

* cited by examiner

*Primary Examiner*—William L. Miller
(74) *Attorney, Agent, or Firm*—Michael A. Guth

(57) ABSTRACT

An urn with a removable and replaceable panel which allows for placement of an image, such as by laser engraving, to be done on the removable panel. The panel may be custom engraved and added to a partially complete urn. An urn wherein the removable and replaceable portion is a photograph with a clear front sheet, such as acrylic or glass. An urn wherein the photograph is matted. A method for creating such a matte.

11 Claims, 20 Drawing Sheets

URN WITH INTERCHANGEABLE DECORATIVE PANEL, MATTED GRAPHICS, AND METHOD FOR MAKING SAME

CROSS REFERENCE TO RELATED APPLICATIONS

This application is a continuation in part of U.S. application Ser. No. 11/053,264 to Roberts, filed Feb. 7, 2005, issued as U.S. Pat. No. 7,308,740.

BACKGROUND OF THE INVENTION

1. Field of Invention

The present invention is related generally to the field of receptacles and memorial plaques, to a method of making a matte for such receptacles, and more particularly to an urn which is adapted to contain the cremated remains of a pet or human.

2. Description of Related Art

The cremation of the mortal remains of living creatures, such as pets, has become increasingly popular. This increasing popularity may be because of a change in demographics, and it is less expensive than in ground burials. The result of the cremation process is a volume of bone fragments which are normally reduced to a fine ash by grinding, resulting in about one cubic inch of cremated remains per pound of body weight.

Some pet owners, or family or friends, choose to retain the cremated remains (also known as cremains) as a memory of the departed loved one. Typically, cremation urns take the form of a vase or a similar type of container where the cremains of the lost loved one are to be placed.

There is an accelerating trend in the afterlife industry towards personalizing the funeral products purchased for the deceased. Rather than providing plastic or tin box urns, for example, such personalizing may include an image remembrance, and in some cases this image is customized to be or contain a photograph of the deceased, or, for animals, an image that includes a breed depiction of the pet in a choice of settings, for example, a farm, country, beach, or mountain setting.

The images can be engraved onto a wooden urn using a CO2 laser or other means. In order to maintain inventory of a large variety of images of different breeds in various style and size of urns and types of woods, many urns would need to be engraved and stored. Occasionally, an engraving may be rejected because of deficiencies in the image, or misplacement of the image. This rejection causes a relatively expensive solid hardwood urn to be scrapped, adding significant cost to the acceptable products.

In some cases, the user may want the urn to memorialize the deceased with a photograph or other specific graphic. This photograph may have outer boundaries of different size than the plaque area of the urn, requiring an outer boundary area, or matte, adapted to "frame in" the graphic. In other cases it may simply be a matter of improved aesthetics to frame in the graphic. However, often the available room in the urn precludes using a thick matte, such as commercial matte material from very thick paper or cardboard.

What is called for is an urn that can be custom engraved, and easily re-engraved in case of error without scrapping an entire urn. What is also called for is an urn which allows for a reduced inventory yet allows for prompt delivery to grieving loved ones. What is also called for is a way to allow for matting in a graphic in such an urn while conserving limited space.

BRIEF SUMMARY OF THE INVENTION

An urn with a removable and replaceable panel(s) which allows for placement of an image, such as by laser engraving, on a removable panel. The panel may be custom engraved and added to a partially complete urn. An urn wherein the removable and replaceable portion contains a photograph or other graphic covered with a clear front sheet, such as glass or acrylic. An urn wherein the photograph is matted. A method for creating such a matte.

DETAILED DESCRIPTION

Figure 1:
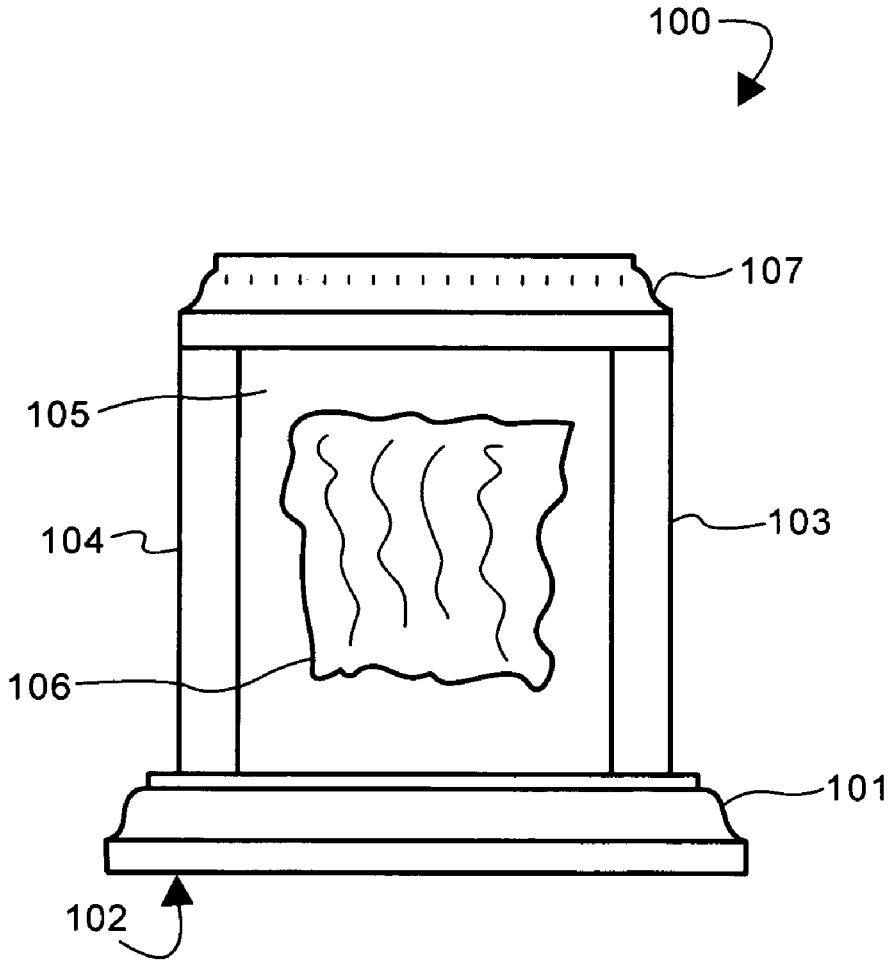
FIG. 1 is a front view of an urn according to some embodiments of the present invention.

FIG. 1 illustrates an urn 100 according to some embodiments of the present invention. The bottom surface 102 of the urn base 101 is adapted to rest upon on a flat surface. The side panels 103, 104 are in substantial contact with the base 101 along their bottom edges. In some embodiments, the side panels 103, 104 are wood and are substantially rectangular in shape. In some embodiments, the side panels 103, 104 are substantially parallel to each other. The urn front panel 105 resides between the side panels 103, 104 as viewed from the front. An image 106 is seen on the front panel 105 in some embodiments. In some embodiments, the front panel is made of wood and the image is a laser engraved image. In some embodiments, the front panel may consist of marble, granite, acrylic, or other suitable materials. The image on the front panel may be a custom image intended to memorialize the pet or person whose remains reside within. The top portion 107 covers over the top of the box created by the front, side, and rear panels.

Figure 2:
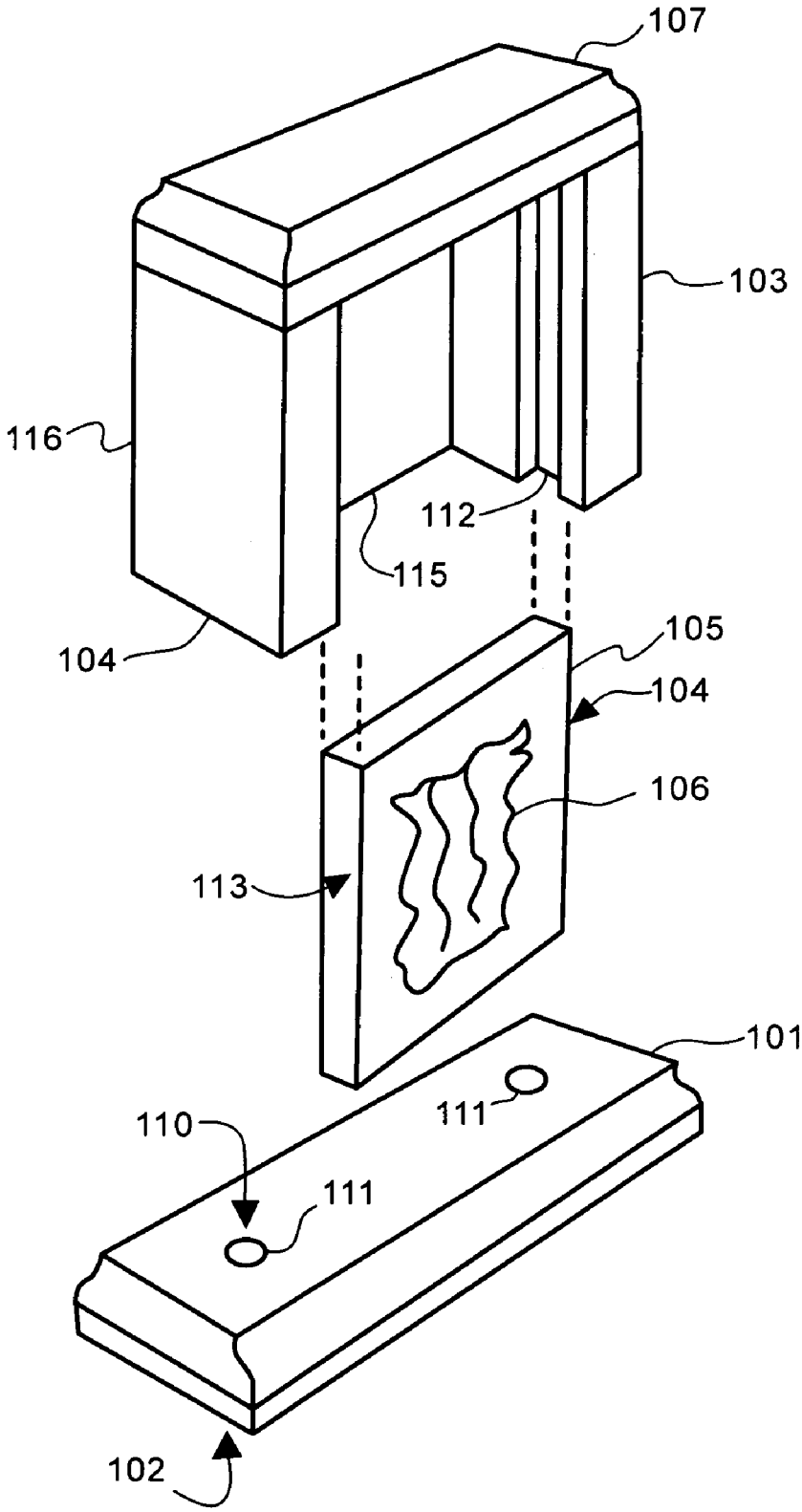
FIG. 2 is an exploded perspective view of an urn according to some embodiments of the present invention.
Figure 10:
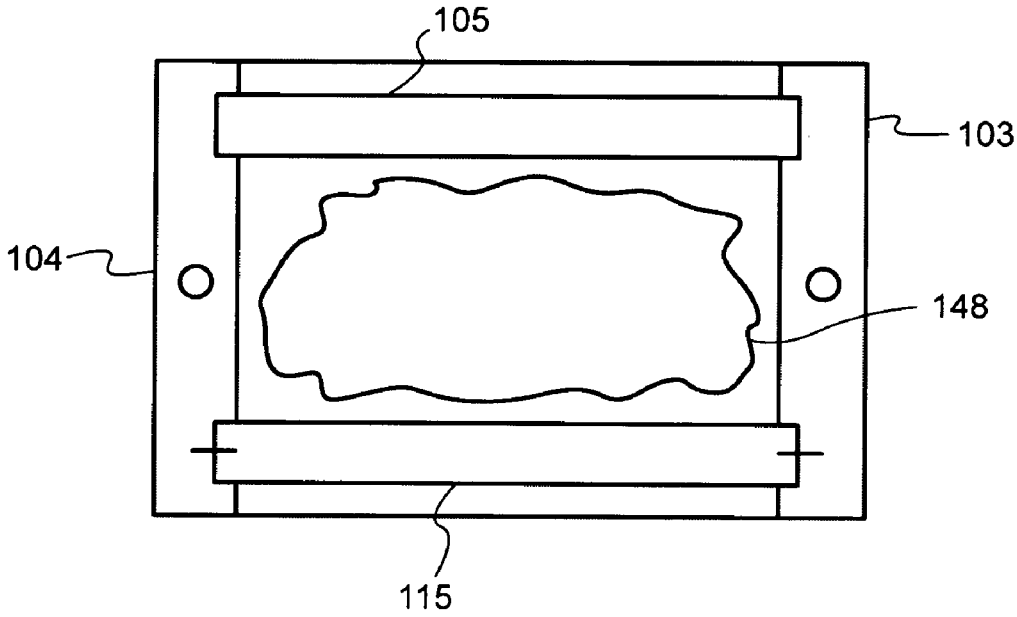
FIG. 10 is a bottom view of an urn body including a four-sided box with a removable additional panel and cremains according to some embodiments of the present invention.

FIG. 2 illustrates an exploded view of an urn according to some embodiments of the present invention. The bottom surface 102 of the base 101 is adapted to lay on a flat surface in some embodiments. Holes 111 in the base 101 are used for attaching the base 101 to the urn body 116. Screws are used to attach the base 101 to the side panels 103, 104. The screws may come up through the base 101 and thread into threaded inserts in the side panels, or they can be threaded directly into the side panels. The top portion 107, the side panels 103, 104, and the back portion 115 may be pre-assembled into the urn body 116. The front panel's sides 113, 114 may be inserted into slots 112, 120 in the side panels. In some embodiments, the front panel 105 slides into the urn body from the bottom. In some embodiments, the front panel 105 fits snugly into the slots 112, 120, and is sized so that it just fits vertically within the space between the top portion 107 and the base 101. In some embodiments, the front panel has slots in it which fit into guides on the side panels. The front panel 105 is easily removable and replaceable. The top surface 110 of the base 101 then captures and retains the front panel 105 when the base 101 is attached to the urn body 116. In some embodiments, the top surface 110 of the base 101 is substantially flat. In some embodiments, the top surface 110 of the base 101 may be recessed for the urn body and front panel. With the front panel in place and the base attached, the urn becomes a closed receptacle which can be used for the remains of a cremated pet in some embodiments. Typically, the remains will be in a separately sealed bag. As seen in FIG. 10, the remains (cremains) 148, typically in a sealed bag, reside within the urn. The front panel 105 is adapted to be easily removed from the urn body 116 when the base 101 is removed.

In some embodiments, the front panel will have an image 106. In some embodiments, the image 106 will be an engraved image. In some embodiments, the image 106 will be engraved by a laser. In some embodiments, the image may be engraved using other methods, or may be marked using another method. The image on the front panel may be customized to suit the desires of a purchaser. Because of the multitude of possible images, the front panel may be engraved as one of the last steps in the assembly process. For example, distributors may have an inventory of urns without front panels permanently attached. When an urn is desired with a particular image, a front panel may be engraved separately and inserted after engraving. The engraving of the front panel separately from the rest of the urn has many advantages. If the image is not engraved properly, the image may be re-engraved on the other side of the front panel, so that the front panel does not need to be scrapped. The image may also be re-engraved on another replacement front panel. In this case, the entire urn does not have to be discarded. In either case, the easily removable and replaceable front panel allows for economy of inventory, and allows for a manufacturing error in engraving to be absorbed without wasting a potentially expensive urn. In addition, the engraving of only the substantially flat and rectangular front panel, as opposed to an engraving process where the entire and bulky urn is placed in the engraver if the engraving is done on a panel already assembled into an urn, may allow for a much easier, accurate, and controllable engraving process. Utilizing such a system, an afterlife service and product provider may be able to keep a reduced inventory of plain (unengraved) urns. When an order for a custom engraving is received, the front panel may be manufactured and then easily mailed to the provider, where the cremains are added and it is then assembled into a completed unit. The expedited delivery of only the decorative panel allows for the use of inexpensive overnight delivery in a padded envelope, for example, as opposed to a much longer delivery time for a parcel with an entire urn.

Figure 9:
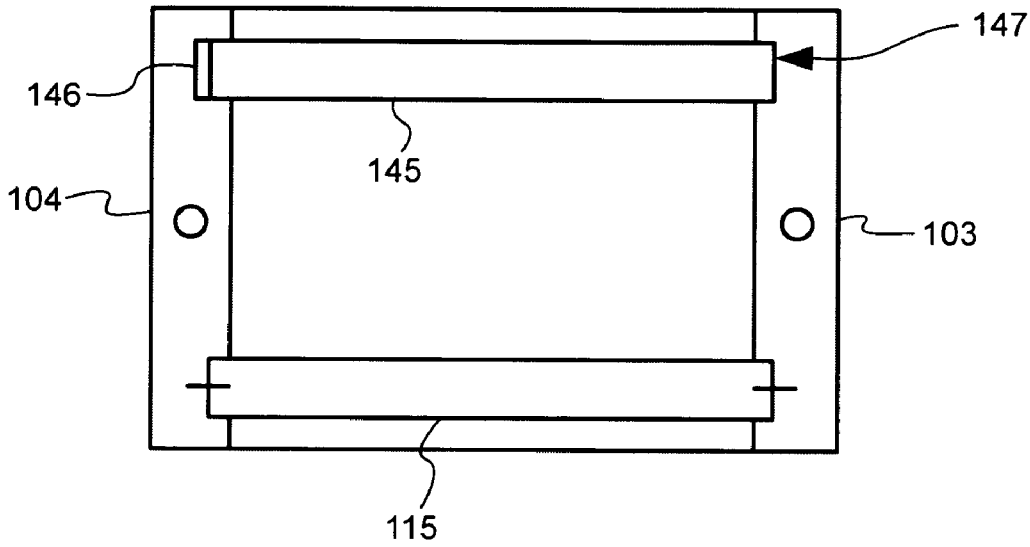
FIG. 9 is a bottom view of an urn body including a four-sided box with a removable additional panel and a shim according to some embodiments of the present invention.

In some embodiments, the image on the front panel of the urn may be of acceptable image quality such that it is not rejected on that basis, but may be off-center horizontally. In such a case, as seen in FIG. 9, a portion of the edge 147 of the panel 145 may be removed by planing or other methods. A shim 146 of appropriate thickness may be inserted into the slot where the other side of the panel resides in order to maintain the snug fit of the now centered panel.

Figure 3:
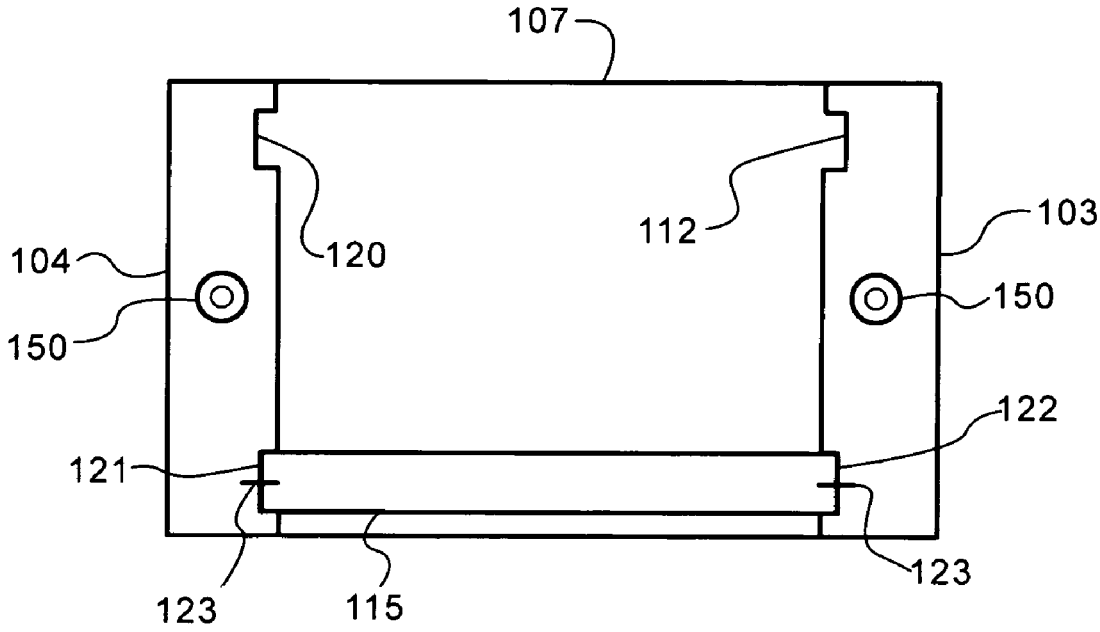
FIG. 3 is a bottom view of an urn body according to some embodiments of the present invention.

In some embodiments, as seen in bottom view in FIG. 3, an urn body has a two side panels 103, 104. The side panels 103, 104 have slots 112, 120 for the later insertion of a front panel. The rear portion 115 has been more permanently affixed into slots 121, 122 in the rear portion of the side panels 103, 104. Slats 123, staples, or other means may be used to fasten the rear portion 115 in some embodiments. In some embodiments, the rear portion 115 is a single panel. In some embodiments, the rear portion is an assembly of pieces. The top portion 107 is affixed to the tops of the rear portion 115 and the side panels 103, 104. In some embodiments, the top portion is affixed using adhesives. In some embodiments, the rear portion is affixed to the side panels with adhesives. In some embodiments, the base is attached to the urn body with threaded fasteners. The fasteners may come up through the bottom of the base and into threaded keepers 150 in the side panels 103, 104, or may thread directly into the panels.

Figure 4:
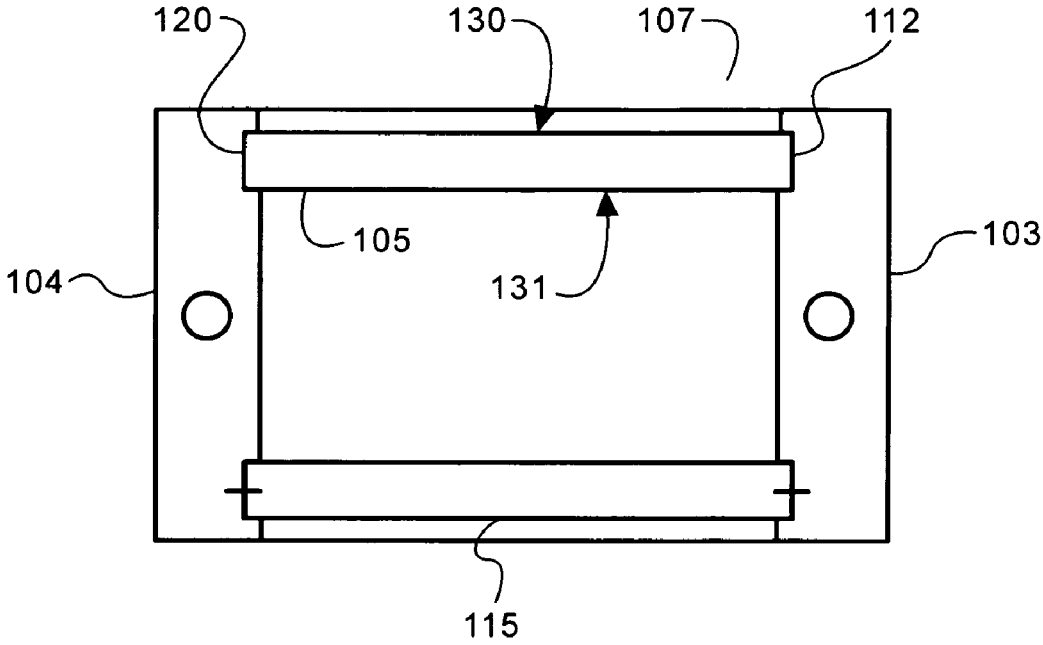
FIG. 4 is a bottom view of an urn body including a removable panel according to some embodiments of the present invention.

FIG. 4 is a bottom view of an urn body with a front panel 105 inserted. A first side 130 and a second side 131 of the front panel 105 may be used for the engraving of an image. In some embodiments, the front panel 105 is made of wood. In some embodiments, the image is engraved on the front panel 105 with a laser. An image may be engraved on the first side 130 of the front panel 105 prior to the insertion of the front panel 105 into the urn body. If, upon inspection, the image on the front panel does not meet standards during assembly or when the urn is assembled, the urn may be disassembled and the front panel may be re-used on the second side 131. The urn may then be re-assembled with the second side 131 facing outwards. In some cases, the front panel may be manufactured with a different view on each side, allowing the customer to select which image is preferred upon review. For example, a breed may have both natural longer ears and cropped ears. An image of each may be engraved, one on each side of the panel. The chosen depiction may be displayed when the urn is fully assembled, without delaying the engraving process and the delivery of the panel.

Figure 5:
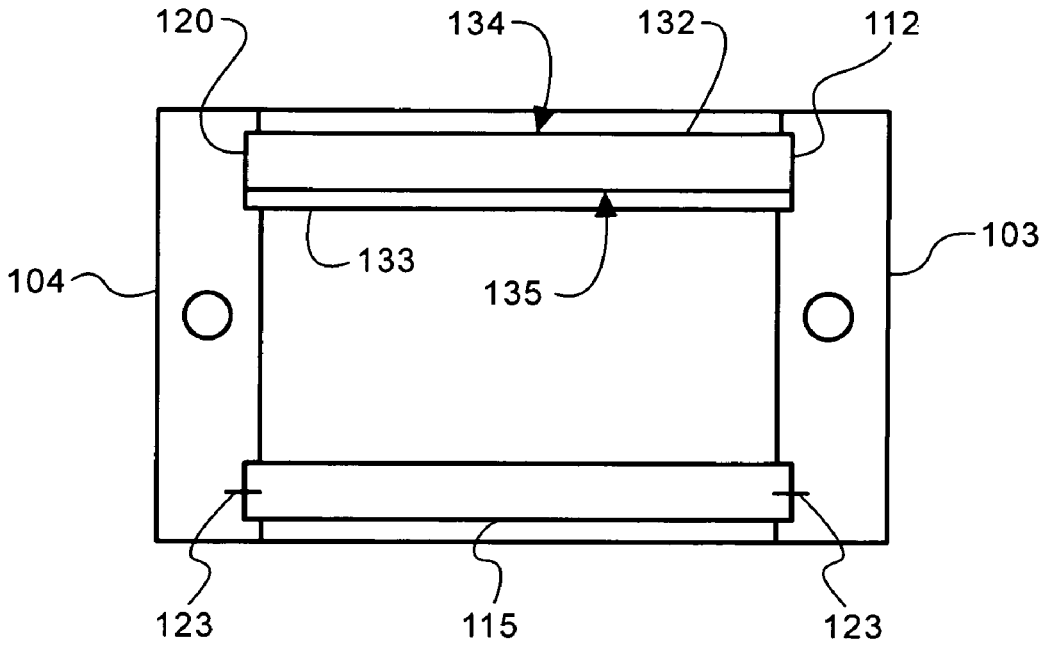
FIG. 5 is a bottom view of an urn body including a removable panel/clear pane combination according to some embodiments of the present invention.
Figure 6:
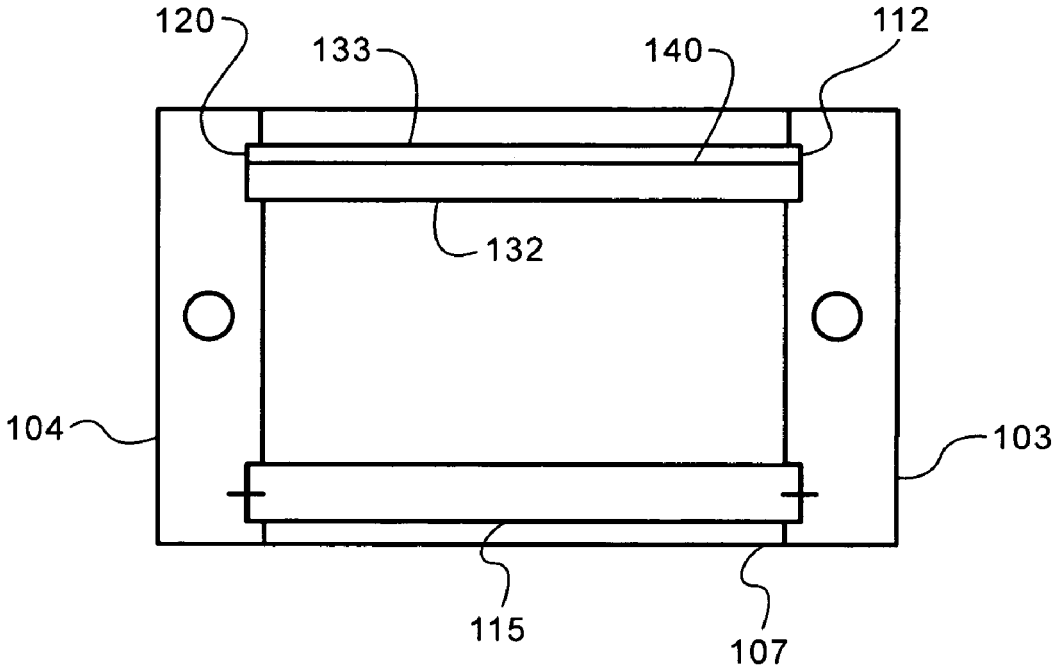
FIG. 6 is a bottom view of an urn body including a removable panel/clear pane combination according to some embodiments of the present invention.

In some embodiments, as seen in bottom view in FIGS. 5 and 6, the slots 112, 120 in the side panels 103, 104 may be adapted to seat a first partial panel 132 and a second partial panel 133. In some embodiments, the first partial panel 132 is made of wood or other suitable material, and the second partial panel 133 is a pane made of a clear material, such as acrylic, glass, or other material. In some embodiments, the two partial panels 132, 133 are sized such that there combined thicknesses allow for a snug fit into the slots 112, 120 in the side panels, while still allowing for easy removal and replacement. The two partial panels allow for the same combination of parts to be used while offering a variety of advantages. The first partial panel 132 may be engraved on one of its surfaces 134, 135 such that an image is displayed outwardly. As in other embodiments, the first partial panel 132 may be engraved separately from the urn. Also, the first partial panel 132 may be engraved on the second surface if there is a manufacturing or other problem with the engraving on the first surface. The second partial panel 133 may be inserted on the outside of the first partial panel 132 in some embodiments. A photograph or other image 140 may be inserted between the first partial panel 132 and the second partial panel 133 and will be visible to a viewer observing the urn.

Figure 7:
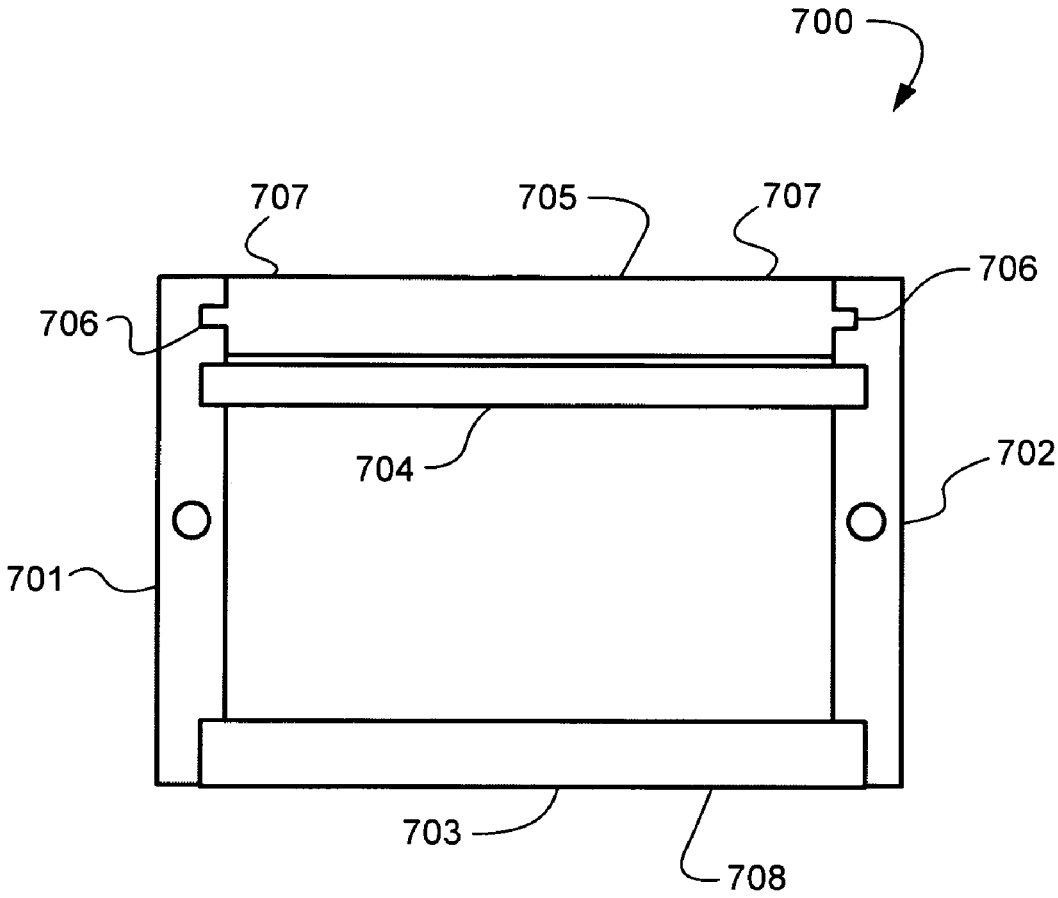
FIG. 7 is a bottom view of an urn body including a four-sided box with a removable additional panel according to some embodiments of the present invention.

In some embodiments of the present invention, as seen in FIG. 7, an urn 700 is shown in bottom view without its base. Two side panels 701, 702 are joined to a back panel 703. In some embodiments, the back panel 703 is made from one or more pieces of wood or other suitable material. A top panel 708 resides on the top of the box assembly.

A front panel 704 is attached to the two side panels 701, 702. The side panels 701, 702 extend past the front panel. A removable panel 705 with guides 707 slides into slots 706 in the side panels 701, 702. In some embodiments, the slots may be in the removable panel. An image may be engraved on either surface of the removable panel 705.

Figure 8:
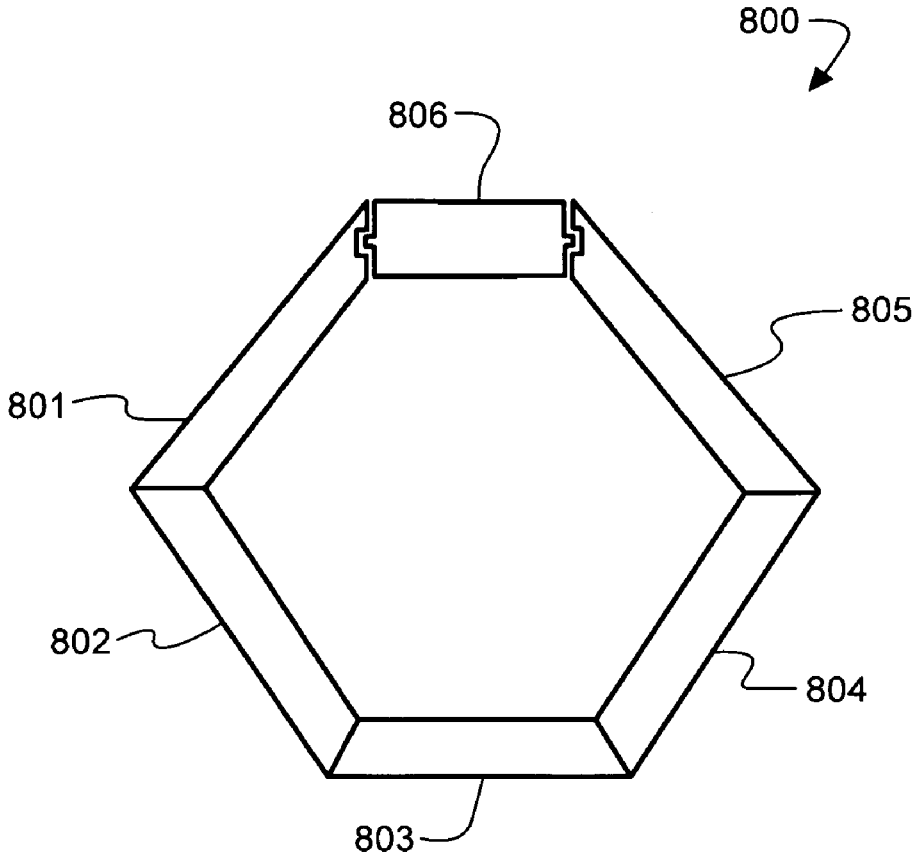
FIG. 8 is a bottom view of a multi-sided urn body with a removable additional panel according to some embodiments of the present invention.

In some embodiments of the present invention, as seen in FIG. 8, the urn body is multi-sided. An urn 800 has a plurality of panels 801-805 joined together to form an urn body. A removable panel 806 is adapted to slide into the urn body. The removable panel is adapted to be captured by the base when the base is attached to the urn body.

Figure 11:
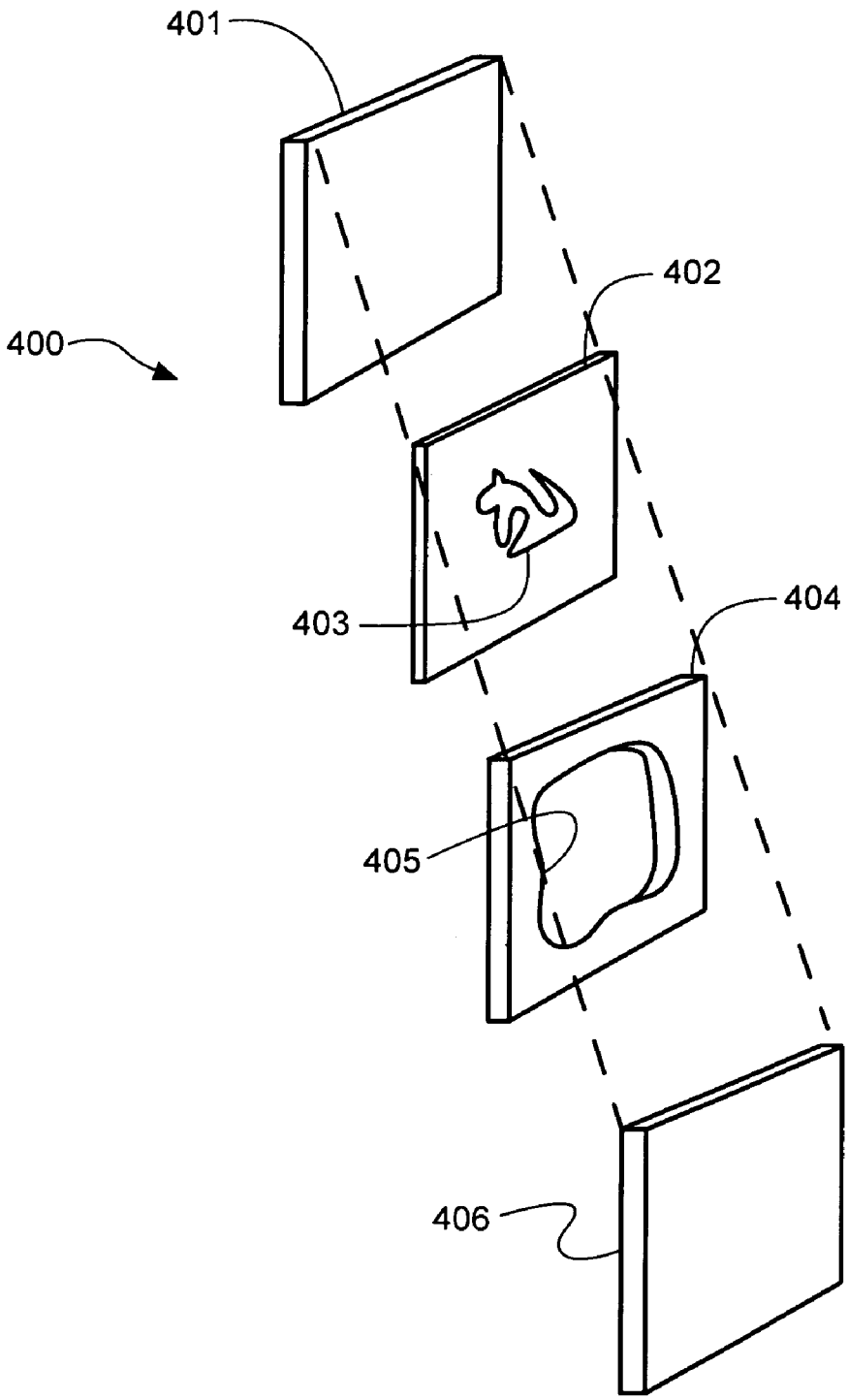
FIG. 11 is an exploded view of a removable panel with a graphic insert and a matte.
Figure 12:
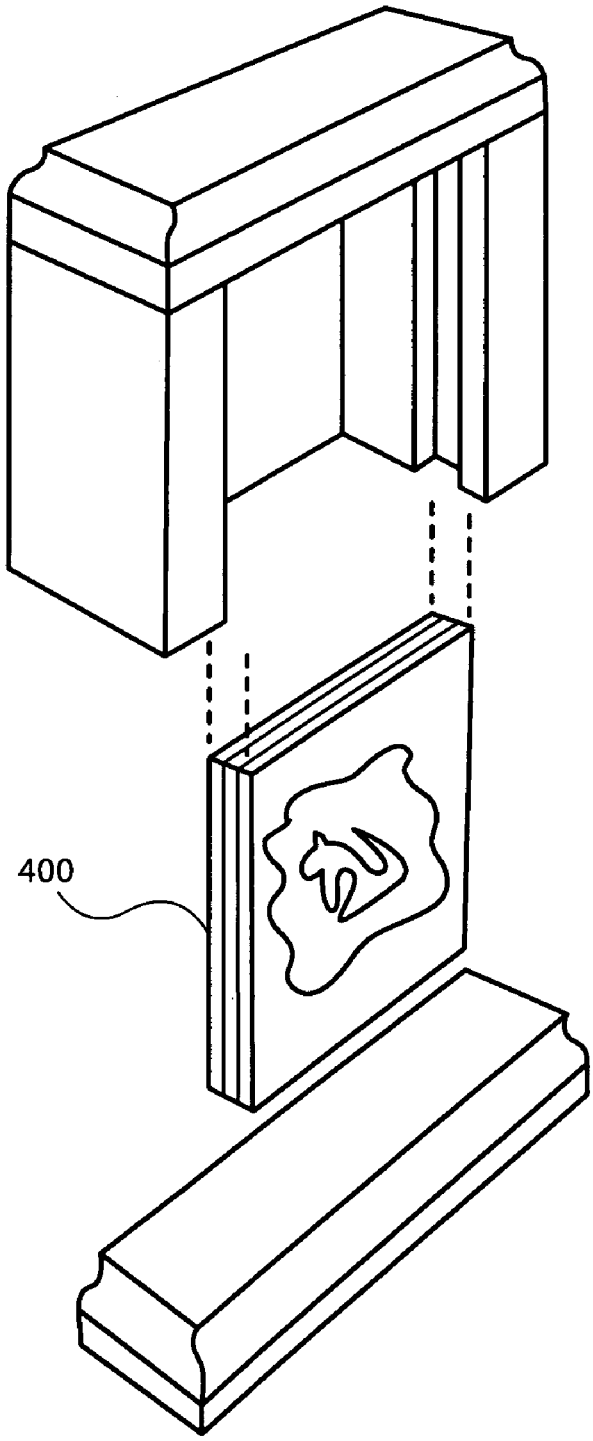
FIG. 12 is an exploded view of a removable panel with a graphic insert and a matte ready for insertion into an urn body.

In some embodiments of the present invention, as seen in FIG. 11, the front panel is an assembly 400 of partial panel portions. A backing panel 401 is used to back and support a graphic 402, such as a photograph. A user may wish to memorialize the deceased with the use of a photograph of the deceased 403. In some cases, the graphic 402 may not be of the same size as the space available and it is appropriate to frame in the graphic using a matte 404 with an opening 405, or in some cases a plurality of openings, within it. In other cases, the matte may be used for aesthetic reasons. A clear front sheet 406, such as of acrylic or glass, may be used to cover the assembly. This approach allows for the use of a graphic to be inserted into the urn, as seen in FIG. 12.

Figure 13:
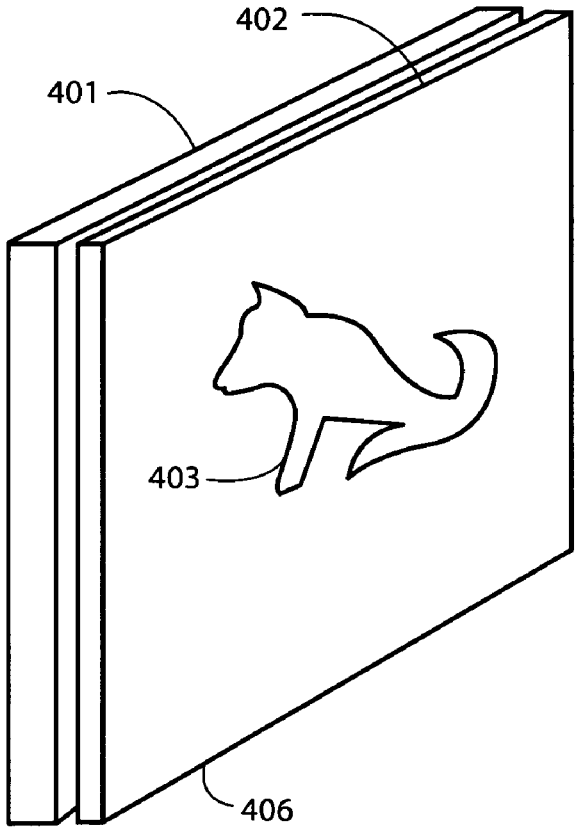
FIG. 13 is a view of a removable panel with a graphic insert.
Figure 14:
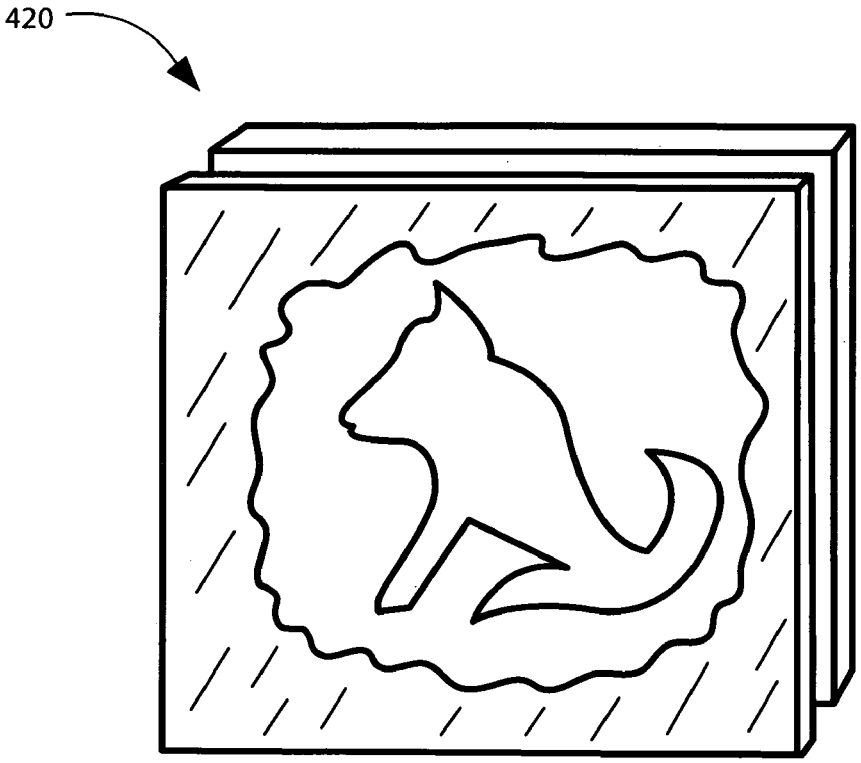
FIG. 14 is a view of a removable panel with a graphic insert and a matte.

FIG. 13 illustrates an assembly of partial panel portions without a matte. A backing panel 401 supports a graphic 402, which may include an image of the deceased 403, and is covered by a front sheet 406. FIG. 14 illustrates an assembly 420 using a matte or framing in of the graphic around its periphery. As noted above, the user may desire the framing in of the graphic for logistic or aesthetic reasons. Although shown with a single opening, there may be more than one opening in the matte in some cases.

In some cases, the user may desire to frame in the graphic but the use of a cardboard matte, which may be of some thickness, can be problematic. The user may desire to achieve the matting, or framing in effect, of the graphic without the addition of such a thick layer. A painted matting may be desirable in such circumstances. The "matte" may be painted, or applied in other fashion, directly onto the back of the clear front sheet. Although the front sheet has been described heretofore as clear, it is understood that the front sheet may be colored, or be less than fully clear in some embodiments.

Figure 15:
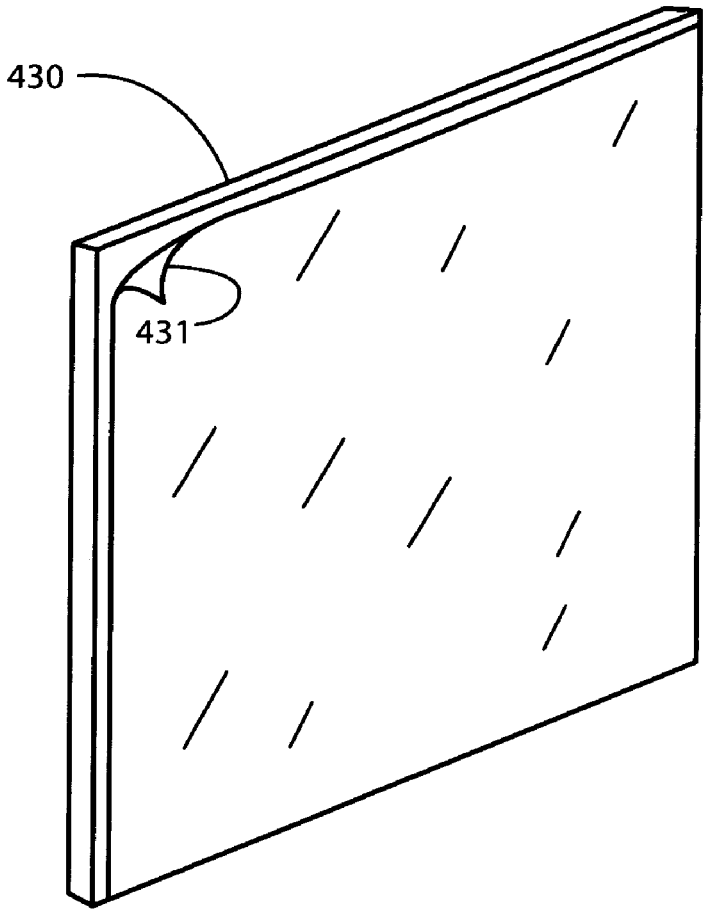
FIG. 15 is a sketch of an acrylic panel with a paper backing sheet.
Figure 16:
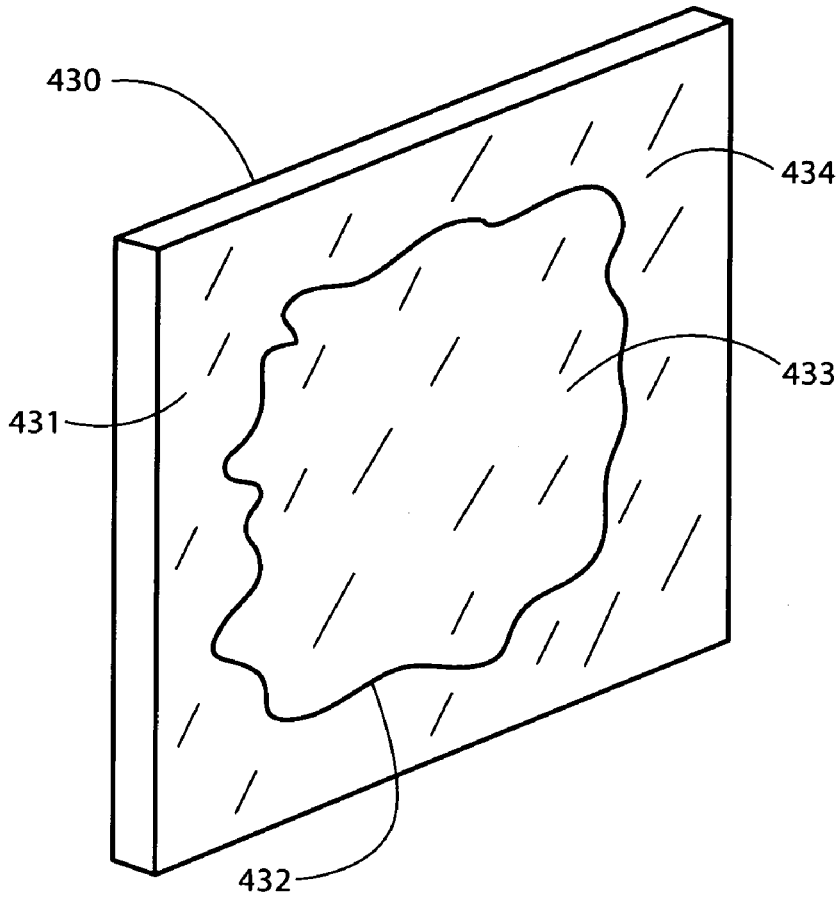
FIG. 16 is a sketch of an acrylic panel with a scored paper backing sheet.
Figure 17:
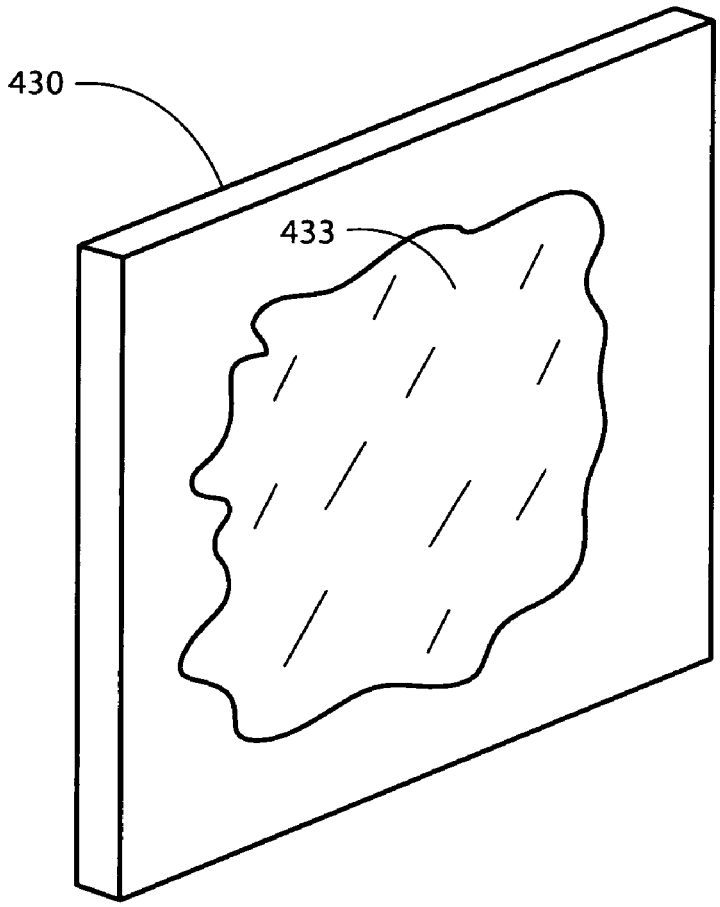
FIG. 17 is a sketch of an acrylic panel with the exterior paper portion removed.

In addition, the user may desire that the matte be of a somewhat more complex shape than a simple opening, and this may be difficult to achieve with a paper board matte. Thus, in order to achieve a complex matte geometry, or to achieve a thin overall stack of the panel including the matte, the following approach is desirable. FIG. 15 illustrates a front partial panel 430, such as an acrylic sheet, with a backing sheet 431, which may be a sheet of paper with an adhesive adhering it to the front partial panel. In some cases, acrylic may be coated with such a sheet prior to final use and insertion into a product to protect it from scratching or other damage. FIG. 16 illustrates the backing sheet 431 with a score line 432 which separates the backing sheet into an interior portion 433 and an exterior portion 434. The score line 432 has cut into the backing sheet 431 such that the exterior portion 434 can be peeled away from the acrylic panel while leaving the interior portion 433, as seen in FIG. 17. The score line thus is a discontinuity in the backing sheet which allows desired portions of the backing sheet to be peeled away, but this peeling does not proceed beyond the score line.

Figure 18:
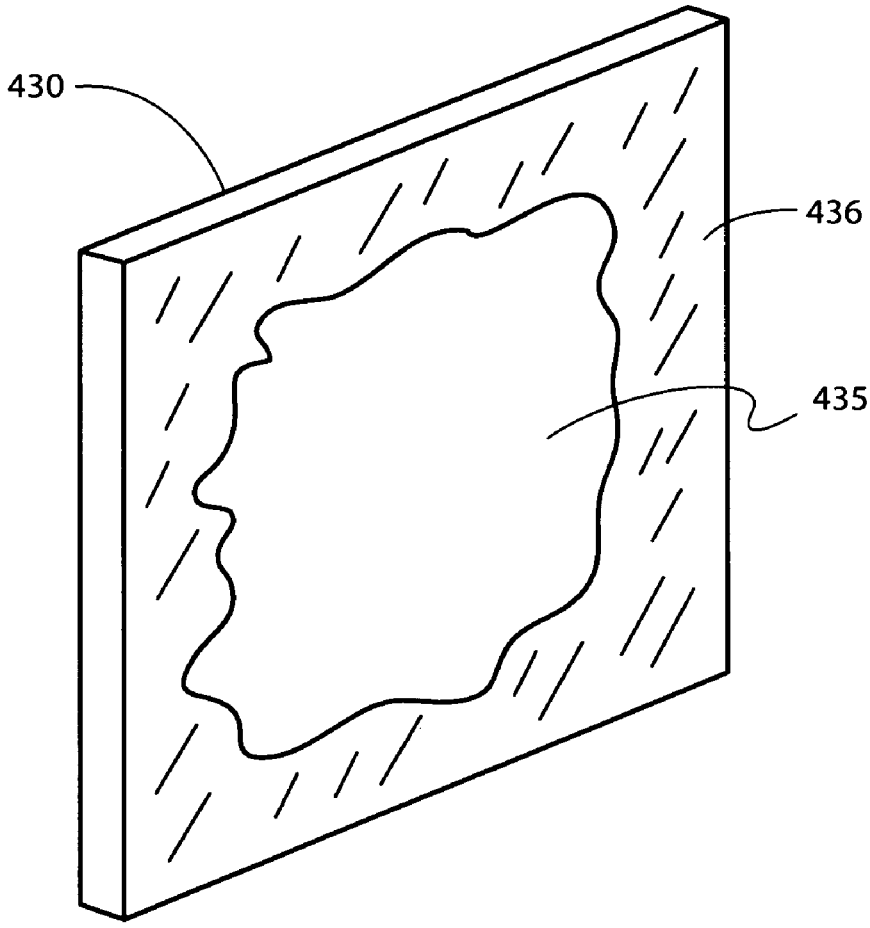
FIG. 18 is a sketch of an acrylic panel with a painted on matte.

The peeled away exterior portion 434, which has left the interior portion 433 on the back of the plate, may act as a negative image of the desired matte which may be painted upon the back of the plate, or applied with other means. When paint is applied to the back of plate, the area of the back of the plate under the interior portion of the backing sheet remains free of the coating. Thus, when the interior portion of the backing sheet is then pulled away, seen in FIG. 18, the back of the plate has a painted, matted portion 436 and an opening 435. There may be more than one opening in other embodiments. Although the above description illustrates the matted portion being placed upon the back of the plate, the user may desire that the matted portion be on the front of the panel, for aesthetic or other reasons, in some circumstances.

The score line 432 may be imparted upon the backing sheet 431 in a variety of ways. For example, the score line may be made by using a hand held implement or blade. However, the score line may also be made using a computer controlled laser system that allows for simple but also complex mattes shapes, and matte shapes that may be custom fitted around and to the graphic to be used as well.

In some embodiments, the score line may be made upon a material which will remain on the back of the front sheet as the matte material itself. For example, a thin vinyl sheet may be adhered to the back of the front sheet. The adhesive may be of a type that leaves no residue when the vinyl is peeled up from the front sheet. The sheet may be made of other appropriate materials. Once scored, the portion of the sheet which is in the area of the desired opening(s) in the matte is removed, leaving a matte in place.

Figure 19:
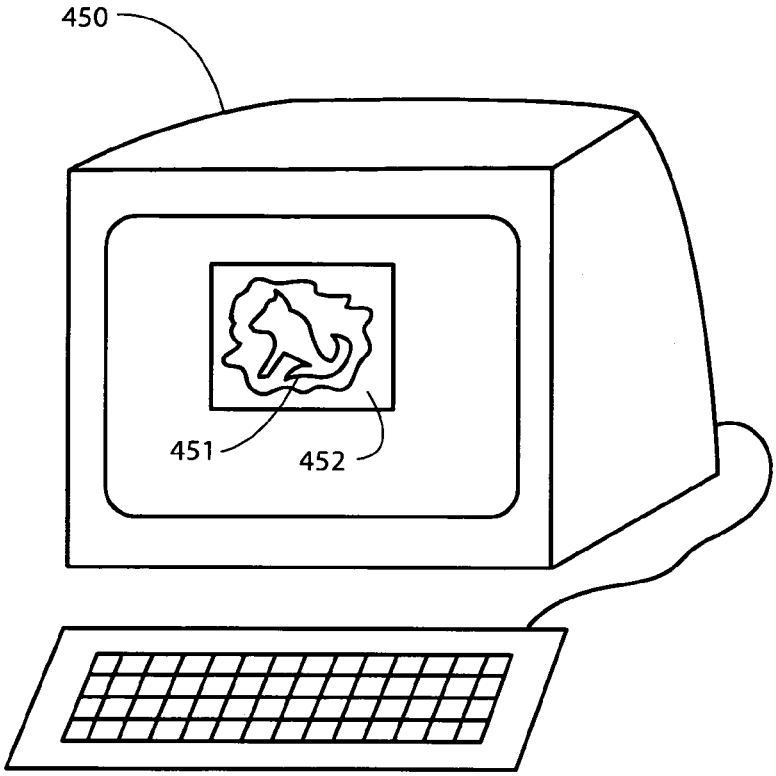
FIG. 19 is a sketch of a computer with a graphic.
Figure 20:
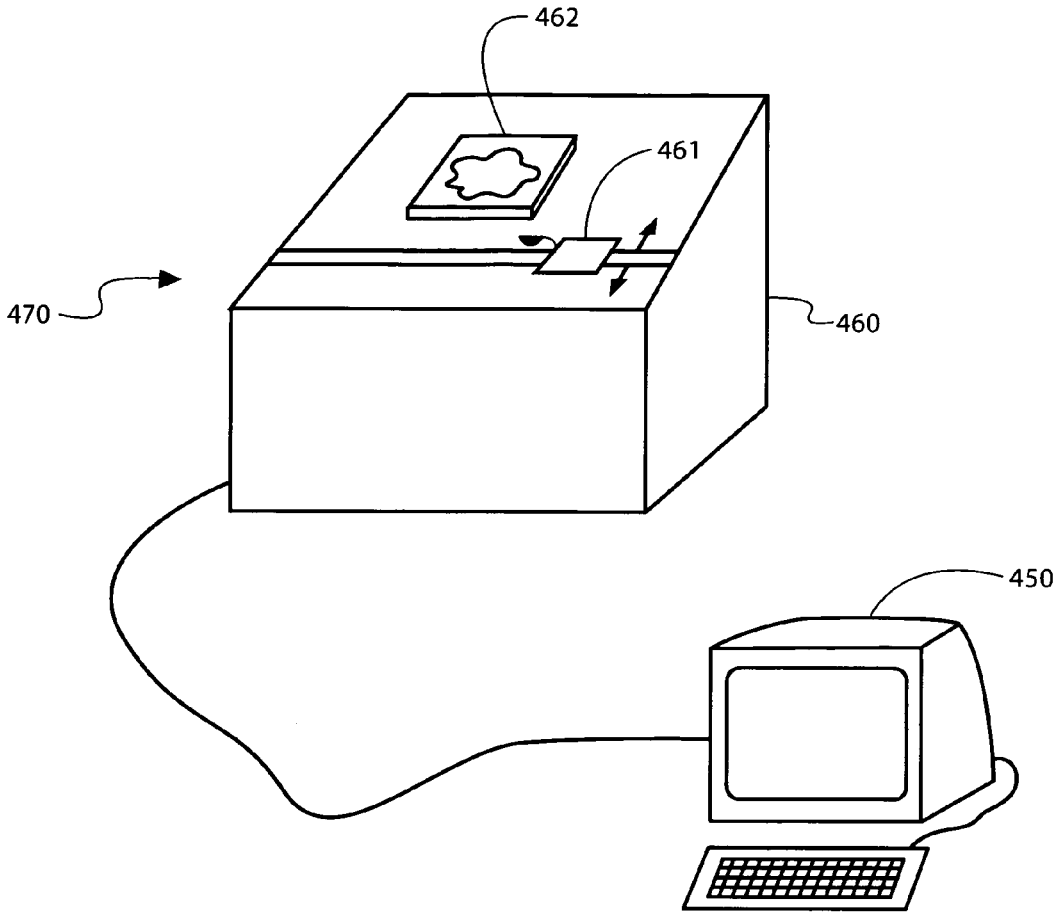
FIG. 20 is a sketch of a computer controlled laser system.

FIGS. 19 and 20 illustrate computer controlled laser system 470 according to some embodiments of the present invention. A computer 450 may be used to direct the activity of a laser system 460. The laser system 460 may have a movable head 461 adapted to direct and focus a laser beam at a work piece 462. The laser beam may be used to score the backing sheet on an acrylic or other plate in such a fashion that the backing sheet is cut through, or cut through enough for easy peeling as described above, without leaving a discernable mark on the plate, although a mark may be left in some applications.

As evident from the above description, a wide variety of embodiments may be configured from the description given herein and additional advantages and modifications will readily occur to those skilled in the art. The invention in its broader aspects is, therefore, not limited to the specific details and illustrative examples shown and described. Accordingly, departures from such details may be made without departing from the spirit or scope of the applicant's general invention.

I claim:

1. An urn for storing cremains, said urn comprising:

an urn body, said urn body comprising:

a first side panel;

a second side panel;

a back portion, wherein said back portion is joined to said first side panel and to said second side panel;

a top portion, said top portion joined to the top of said urn body;

a front panel portion, said front panel adapted to fit with said urn body to form a fourth side of a box structure, wherein said first side panel, said second side panel, and said back portion define a first, second, and third side, respectively, of said box structure; and a base, said base adapted to fasten to the bottom of said urn body, said base having a top surface adapted to capture said front panel portion when fastened to said urn body, whereby with said front panel portion and said base attached to said urn body, said urn is a closed receptacle for storing said cremains;

wherein said front panel portion comprises:

a first partial panel;

a second partial panel; and a matte layer between said first partial panel and said second partial panel, wherein said second partial panel comprises a clear material, and wherein said first partial panel and said second partial panel are adapted to overlay each other.

2. The urn of claim 1 further comprising an image layer, said image layer is interlayed between said first partial panel and said second partial panel.

3. The urn of claim 2 wherein said matte layer comprises paint, and wherein said matte layer is painted onto the inside of said second partial panel.

4. The urn of claim 3 wherein said first side panel comprises a first slot along its inside face, and wherein said second side panel comprises a second slot along its inside face, and wherein said first slot and said second slot extend to a bottom edge of said urn body, said first slot and said second slot adapted to capture two opposing sides of said front panel portion.

5. The urn of claim 2 wherein said matte layer comprises a thin sheet adhered to the inside of said second partial panel.

6. The urn of claim 5 wherein said matte layer further comprises vinyl.

7. An urn for storing cremains, said urn comprising:

an urn body, said urn body comprising:

a first side panel;

a second side panel;

a back portion, wherein said back portion is joined to said first side panel and to said second side panel;

a top portion, said top portion joined to the top of said urn body;

a front panel portion, said front panel adapted to fit with said urn body to form a fourth side of a box structure, wherein said first side panel, said second side panel, and said back portion define a first, second, and third side, respectively, of said box structure; and a base, said base adapted to fasten to the bottom of said urn body, said base adapted to capture said front panel portion when fastened to said urn body;

wherein said front panel portion comprises:

a first partial panel;

a second partial panel; and a matte layer between said first partial panel and said second partial panel, wherein said first side panel comprises a first slot along its inside face, and wherein said second side panel comprises a second slot along its inside face, and wherein said first slot and said second slot extend to a bottom edge of said urn body, said first slot and said second slot adapted to capture two opposing sides of said front panel portion.

8. An urn for storing cremains, said urn comprising:

an urn body, said urn body comprising:

a first side panel;

a second side panel;

a back portion, wherein said back portion is joined to said first side panel and to said second side panel;

a top portion, said top portion joined to the top of said urn body;

a front panel portion, said front panel adapted to fit with said urn body to form a fourth side of a box structure, wherein said first side panel, said second side panel, and said back portion define a first, second, and third side, respectively, of said box structure; and a base, said base adapted to fasten to the bottom of said urn body, said base having a top surface adapted to capture said front panel portion when fastened to said urn body, whereby with said front panel portion and said base attached to said urn body, said urn is a closed receptacle for storing said cremains;

wherein said front panel portion comprises:

a first partial panel;

a second partial panel, said second partial panel comprising a front and a back; and a matte layer on the front of said second partial panel.

9. The urn of claim 8 wherein said second partial panel comprises a clear material.

10. The urn of claim 9 wherein said first partial panel and said second partial panel are adapted to overlay each other.

11. The urn of claim 10 wherein said matte layer further comprises paint.

* * * * *